US005287805A

United States Patent [19]

Fischer et al.

[11] Patent Number: 5,287,805

[45] Date of Patent: Feb. 22, 1994

[54] FOLDING APPARATUS

[75] Inventors: Emil Fischer, Ludwigshafen-Oggersheim; Rudolf Staeb, Frankenthal, both of Fed. Rep. of Germany

[73] Assignee: Albert-Frankenthal Aktiengesellschaft, Wurzburg, Fed. Rep. of Germany

[21] Appl. No.: 920,558

[22] PCT Filed: Feb. 19, 1991

[86] PCT No.: PCT/DE91/00126

§ 371 Date: Aug. 19, 1992

§ 102(e) Date: Aug. 19, 1991

[87] PCT Pub. No.: WO91/12195

PCT Pub. Date: Aug. 22, 1991

[30] Foreign Application Priority Data

Feb. 19, 1990 [DE] Fed. Rep. of Germany ..... 4005195
Feb. 22, 1990 [DE] Fed. Rep. of Germany ..... 4041613

[51] Int. Cl.[5] ..... B41F 5/04
[52] U.S. Cl. ..... 101/219; 270/47
[58] Field of Search ..... 101/219; 270/47, 48, 270/49, 50, 13, 19, 20.1, 60

[56] References Cited

U.S. PATENT DOCUMENTS 3,263,988 8/1966 Heimlicher ..... 270/50
4,946,751 8/1990 Liebert ..... 270/47
5,000,433 3/1991 Priim et al. ..... 270/47
5,039,076 8/1991 Fischer ..... 270/50
5,065,993 11/1991 Reponty ..... 270/49
5,078,374 1/1992 Odeau ..... 270/49
5,096,174 3/1992 Nishihara ..... 270/47

FOREIGN PATENT DOCUMENTS 0066867 6/1982 European Pat. Off. .
0098415 6/1983 European Pat. Off. .
0355595 8/1989 European Pat. Off. .
2714915 4/1977 Fed. Rep. of Germany .
3810439 3/1988 Fed. Rep. of Germany .

*Primary Examiner*—Eugene H. Eickholt
*Attorney, Agent, or Firm*—Jones, Tullar & Cooper

[57] ABSTRACT

In a folding apparatus with a collect cylinder (1) which can be switched from collect production to non-collect production, the holding elements and folding blades of which are connected with actuating elements, preferably embodied as scanner rollers (14, 15), which can be controlled by a respectively associated radial cam (12 or 13), the control area of which, preferably embodied as a control recess (16), can be selectively uncovered or covered by means of a cover device provided with cover cams (17) disposed on a drivable cam support (22) which is coaxial with the radial cam (12 or 13), a great variability in respect to feasible collect operations is attained in that the cover cams 17.1–17.8 of each cover device are received radially displaceable on the respectively associated cam support (22).

4 Claims, 8 Drawing Sheets

FOLDING APPARATUS

FIELD OF THE INVENTION

The invention relates to a control for folding blades and/or grippers of a collector cylinder in a folding apparatus of a web-fed rotary printing press.

DESCRIPTION OF THE PRIOR ART

The cover device contains a drivable cover disk with fixedly disposed cover cams. With an arrangement of this type it is necessary that the cover disk not only runs during collect production, but also during non-collect production, which often occurs in actual operation. With an arrangement of this type the number of successive collect operations is very limited. Experience has shown that the limit is reached here with two successive collect operations. More than two collect operations are impossible here.

On the other hand, the width of the printing press and with it that of the printing cylinder diameters is increased, so that the result is more etchings (sides) at the circumference than previously for example eight etchings at the circumference.

SUMMARY OF THE INVENTION

It is the object of the invention to provide a control for folding blades and/or grippers of a collector cylinder having seven gripper systems and seven folding blades, by means of which "partial collect" is possible.

The advantages attainable by means of the invention consist particularly in that the number of successive collect operations, and thus the number of possible production types, can be increased with simple and cost-effective means. In an advantageous manner these are the following productions:

1. Non-collect, using 4U-, 6U- or 8U-printing cylinders,
2. Dual collect, using 4U- or 8U-printing cylinders,
3. Triple collect, using 6U-printing cylinders,
4. Quadruple collect, using 8U-printing cylinders,
5. Partial collect (non-collected signatures plus dual collected signatures), using 6U-printing cylinders,
6. Partial collect (non-collected signatures plus triple collected signatures), using 8U-printing cylinders.

"Partial collect" is understood to mean that not only non-collected products, but also collected products are continuously generated in one production position, for example C; A+B with 6U-printing cylinders, and A; B+C+D with 8U-printing cylinders.

It furthermore advantageous that practically a variable type of cover disk is obtained and therefore more than two collect operations can be performed.

The result is a more universal folding apparatus than before, by means of which all products of a printing cylinder with up to eight etchings can be easily collected on top of each other during one revolution, which allows the efficient production of even comparably thick products. Another advantage of the measures in accordance with the invention can be seen in that the variable cover disk can simply stand still during non-collect production, in the course of which all or at least the interfering cover cams are simply retracted, which is advantageous in that unnecessary wear is prevented.

In an advantageous embodiment of the relevant measures, the cover cams can be adjustable by means of an adjusting disk which is coaxial to the cam support, can be driven together with the cam support and is adjustable in respect to the latter in the peripheral direction. This measure permit a simple adjustment of the cover cam by turning the adjusting disk, which permits automatic adjustment. In a practical way, the cam support and the associated adjusting disk driven in the same way could in this manner be drivably connected with each other by means of a differential gear, which can be adjustable by means of an auxiliary drive device which can be rendered passive during the production run. After having been set, the differential gear functions practically as an inherently rigid transfer organ.

A further advantageous step can consist in that the cam supports or adjusting disks associated with the folding blades and the retaining elements are each connected with each other fixed against relative rotation, and are preferably releasably clamped against each other. These measures permit a common drive of the two cam supports or the two adjusting disks, which can make the structure very much simpler and at the same time assures great accuracy. The radial cam associated with the retaining elements can preferably be adjustable in the peripheral direction by means of an auxiliary drive device which can be rendered passive during the production run. This makes possible an adaptation to the respective production in the sense that shorter sizes are released sooner than longer ones.

A further advantageous measure for simplifying the pressure cam arrangement and the adjusting disks can consist in that during collect production the cover device can be driven at different speeds, depending on the number of the desired collect operations.

In a further advantageous embodiment of the relevant measures, the drive device associated with the cover devices can have an intermediate shaft which is parallel to the cylinder shaft, by means of which the cam supports can be can be directly driven and the adjusting disks can be driven by interposition of the adjustable differential gear, and which shaft can be coupled by means of a coupling element slidably disposed on it in exact register with each one of oppositely located drive wheels of different diameters disposed on it, so they are freely turning and and meshing with different margins of a double wheel driven by a cylinder part. In an advantageous manner this results in operational positions with different drive speeds by means of the coupling element. By means of this it is therefore possible in a simple manner to drive the cover devices in the course of collect production as a function of the number of the desired collect operations.

In the case of a double-width folding apparatus with folding blades and retaining devices distributed over the width of the folding apparatus and with control devices disposed in the area of both ends of the cylinder with associated cover devices, they can be simply drivable by means of a common intermediate shaft radially disposed outside of the collect cylinder and extending over the length of the cylinder, so that a coupling device of the type sketched above is required in the area of only one cylinder end, which simplifies construction.

Further advantageous embodiments and useful further embodiments of the relevant measures ensue from the remaining dependent claims in connection with the following description of a preferred exemplary embodiment.

DESCRIPTION OF THE DRAWINGS

The exemplary embodiment illustrated in the drawings will be described in detail below.

Shown in the drawings are in.

DESCRIPTION OF THE PREFERRED EMBODIMENT

Figure 1:
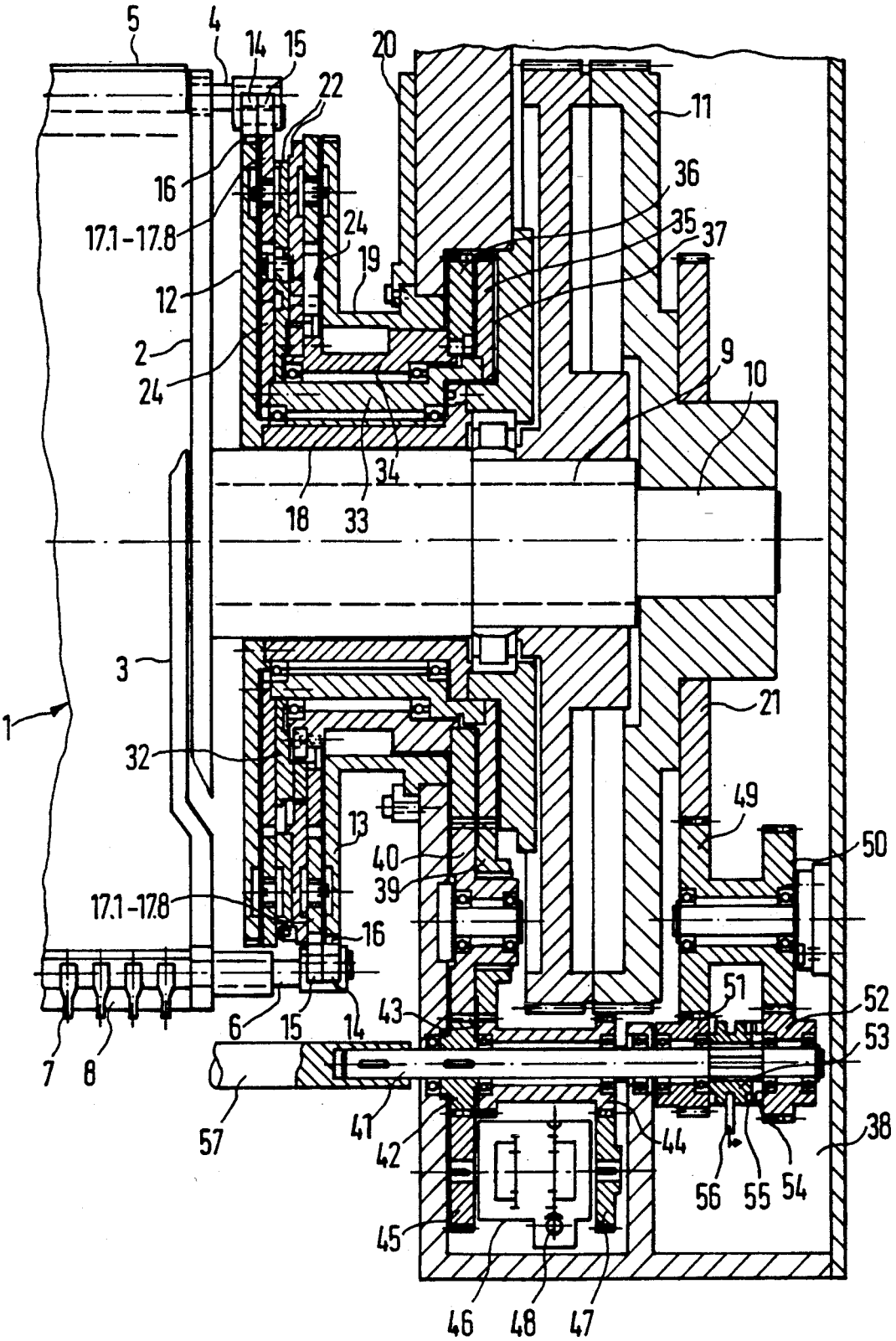
FIG. 1 a longitudinal section through the drive and control device of a collect cylinder of a folding apparatus in accordance with the invention, FIGS. 2 to 8 views of a variable cover disk in accordance with the invention, provided with retractable and extendible cover cams, in different cam positions for different types of production.

The collect cylinder 1 of a variable folding apparatus shown in FIG. 1, such as is, as a rule, placed downstream of a web-fed rotary gravure printing press, consists of two evenly drivable fixture supports, star-shaped in cross section, in the form of a laterally seated folding blade part 2 and of a gripper part 3 seated thereon. The folding blade part 2 has been provided with folding blades 5, actuable by means of an actuation device. The gripper part 3 is provided with gripper bars 8, actuable by means of an actuation device 6, and equipped with grippers 7. Drive wheels 11 of equal diameter are fastened side-by-side on the bearing journals 9 or 10 of the folding blade part 2 or the gripper part 3 and are disposed coaxially in relation to each other, and can be coupled by means of a bridging drive, not shown in detail here, for achieving an even drive with a simultaneous adjustment possibility.

For performing a folding operation, the folding blades 5 are extended and the grippers 7 opened. Radial cams 12 or 13, disposed coaxially with the cylinder axis, are provided for this purpose in the area of the front face of the cylinder and are scanned by the associated actuation devices 4 or 6. For this purpose the actuation devices 4 or 6 are each provided with two scanning rollers 14, 15, disposed on a common shaft next to each other, of which the one scanning roller 14 runs on the respective associated radial cam 12 or 13, and the other scanning roller 15 runs on a cover device, adjoining each one of the radial cam 12 or 13, for lateral covering of the cam recess 16 on the side of the radial cam, by means of which the actuation of the folding blades 5 or the grippers 7 is performed. The radial cams 12 or 13 are circular-arc-shaped outside the cam recess 16 on the radial cam side. Depending on the production operation, the cam recesses 16 are exposed during every rotation of the collect cylinder 1 (non-collect) or during each nth rotation of the collect cylinder 1 (collect) and are otherwise laterally covered. For this purpose the cover devices are provided with cover cams 17.1–17.8, disposed parallel to the respectively associated radial cam 12 or 13. The width of the scanning rollers 14 or 15 corresponds to the width of the radial cams 12, 13 or of the cover cams 17.

The radial cams 12, 13 are at rest in relation to the driven collect cylinder 1. The radial cam 12 provided for controlling the folding blades 5 is fixed on a bushing 18 which encloses the outer bearing journal 19 and is fastened on the housing. The radial cam 13 associated with the grippers 7 is fixed in a radially outer bushing 19, rotatably seated in the machine frame, on which an adjusting tongue 20 is fastened, by means of which the gripper 7 can be adjusted in the peripheral direction for setting the opening time of the grippers 7. The adjusting tongue 20 can be drivable by means of an auxiliary drive device in the form of an auxiliary motor etc. provided for setting the format, or simply manually actuable. During the production run the adjusting tongue 20 is secured against rotation. The cover devices with the cover cams 17 and associated with the radial cams 12 or 13 are driven in relation to the stationary radial cams 12, 13 during the production run. For this purpose a toothed drive ring 21 is flanged to the outer drive wheel 11, from which the drive of the cover devices associated with each of the two radial cams 12 or 13 is derived.

Figure 2:
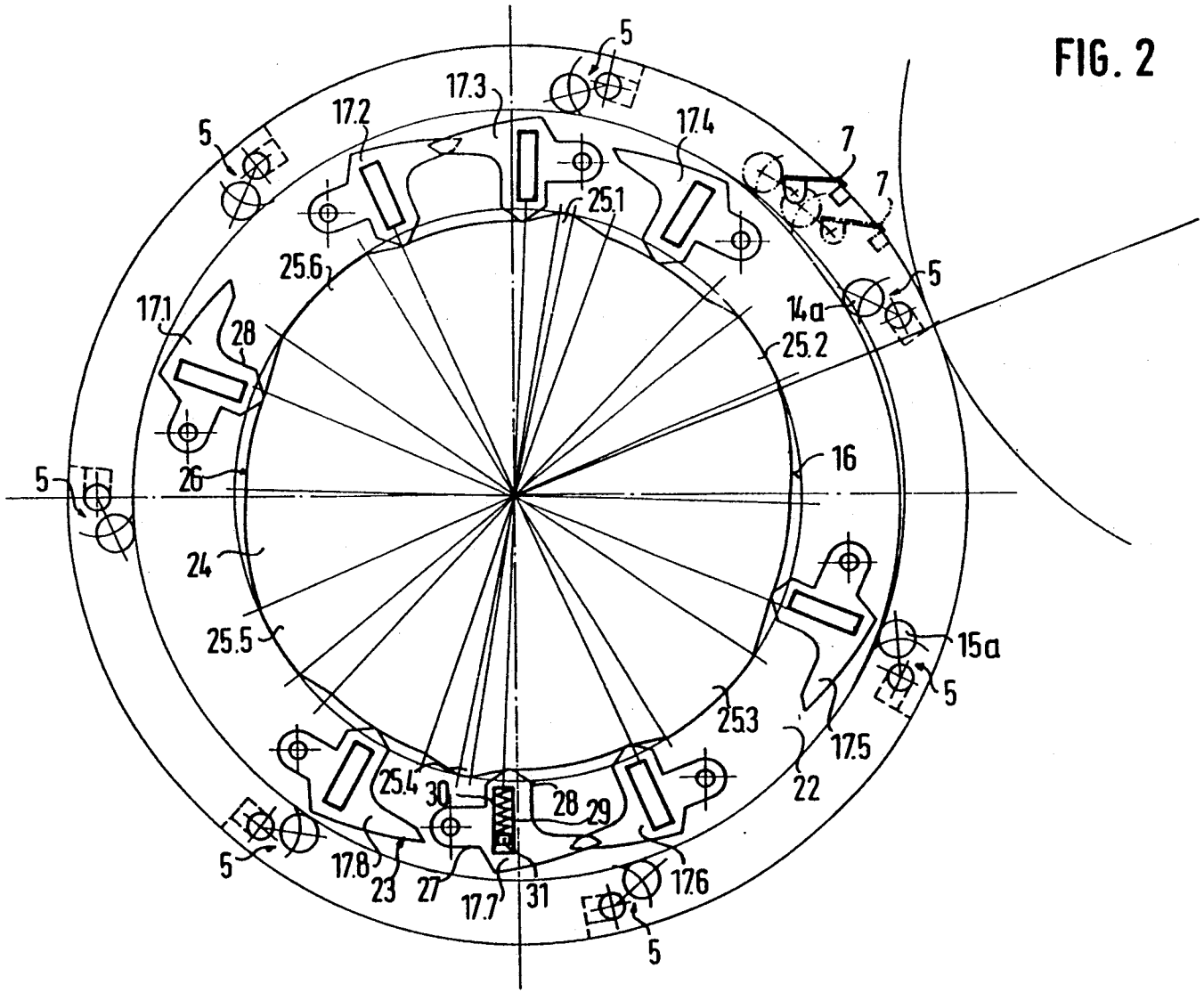

As shown schematically in FIG. 2 in connection with the cover device associated with the radial cam 12 assigned to the folding blades, the two cover devices each comprise a cam support 22, disposed coaxially with the respective radial cams 12, 13, on which the cover cams 17.1–17.8 are received, adjustable in a radial direction. The peripheral shape 23 of the cover cams 17.1–17.8 corresponds to a section of a circle with a radius corresponding to the radius of the circular radial cam 12, 13 formed outside of the control recess 16 in the form of a peripheral cutout. The peripheral shape 23 of the cover cams 17.1–17.8 can be moved adjustment of the cover cams 17.1–17.8 from a radially outer active position, which coincides with the circular-arc shape of the associated radial cam 12, 13, into a passive position located radially inside of the control recess. In the active position, the cover cam 17.1–17.8 laterally cover the recess 16 when passing it, so that, when passing over the control recess 16, the scanning roller 14 running on the respective radial cam 12 or 13 is prevented by the adjoining scanning roller 15, running on a cover cam 17.1–17.8, from falling into the control recess 16 and triggering a folding operation, as indicated at 15*a*. The actuation device associated with the folding blade 5, which in FIG. 2 is just passing through the folding gap, however, can fall into the control recess 16 and perform a folding operation, as indicated at 14*a*. An adjusting disk 24, disposed coaxially with the cam support 22 and flush in the axial direction with the cover cams and provided with fixed control cams 25 and peripheral cutouts located between them, is provided for adjusting the cover cams 17.1–17.8.

Each of the cover cams 17.1–17.8 is fastened on a pivot arm 27, which is pivotably seated on the cam support 22 by means of a paraxial pivot shaft and provided with a radially inwardly protruding scanner 28, which is pressingly maintained against the peripheral shape of the associated adjusting disk 24 by the force of a pressure spring 29. The pressure spring 29 is seated in a cutout 30 of the associated cover cam 17.1–17.8 and is supported on the one end on the inner end of the recess 30 on the cam side and on the other end on a pin 31, which extends into the recess 30 and is fastened on the cam support 22.

Following the adjustment of the adjusting disk 24, the adjusting disk 24 and the cam support 22 supporting the cover cams 17.1–17.8 are evenly driven during operation, so that during operation the cover cams 17.1–17.8 retain their position set by the adjusting disk 24. The drive speed of the entire cover arrangement constituted by the cam supports 22 and the adjusting disk 24 then is selected as a function of the respective production mode in such a way, that the respectively extended cover cams 17.1–17.8 pass the control recess 16 in such a way that only the desired number of folding operations are performed.

Because the folding blades 5 and the grippers 17.8–17.8 associated with them operate synchronously, the two cam supports 22 and the two adjusting disks 24 of the respectively associated cover device can be fixedly connected with each other in order to simplify the drive device required for their operation. As can be further seen in FIG. 1, the two radial cams 12 or 13 are accordingly placed at such an axial distance from each other that both cover devices, which are provided with cam supports 22 touching each other, can be placed between them. The back-to-back disposed cam supports 22 are firmly clamped to each other by clamping devices. The adjusting disks 24, which extend below the respective associated radial cam 12 or 13 facing the cover cams 17.1–17.8 are screwed together with a spacer element 32 interposed, the thickness of which corresponds to the total thickness of the clamped-together cam supports. Two bushes 33, 34, disposed so they extend over each other, are provided for seating of the cam supports 22 or cover disks 24 connected with each other in the area between the bushings 18, 19 supporting the radial cams 12, 13, where the radially inner bushing 33 supports the cam supports 22 directly adjoining each other, and the radially outer bushing 34 supports the adjusting disks 24 connected with each other with the spacer element 32 interposed. The radially inner edge of one of each of the adjustment disk 24 and one of the cam supports 22 extends as far as the associated bushing 33 or 34 and is bolted to it. The respectively other adjusting disk 24 and the respectively other cam support 22 can terminate farther out. The spacing element 32 extends with its spacing cheeks through openings, associated with them, of the cam support 22 fastened on the bushing 34. The other cam support 22 envelops the spacing element 32.

The bushings 33, 34 supporting the adjusting disks 24 or the cam supports 22 are rotatably seated and provided on their ends remote from the cylinder with flanged toothed drive rings 35, 36 of equal diameter, which are received in a chamber 37 bounded by the housing parts containing the bushings 18, 19 on the side of the radial cams and which is accessible from the gear box 38. The toothed drive rings 35, 36 are in engagement with associated intermediate wheels 39, 40 of equal diameter, which are seated on the side of the frame. In this case the intermediate wheel 40 seated in the drive train associated with the cam support 22 is in engagement with a pinion 42 wedged on an intermediate shaft 41 disposed parallel with the cylinder axis outside of the collect cylinder diameter. The intermediate wheel 39 belonging to the drive train of the adjusting disks 24 is in engagement with a toothed ring 43 of a double wheel seated on the intermediate shaft 41, the two toothed rings of the double wheel having the same diameter as the pinion 42. The latter is in engagement with the front wheel 45 of a differential gear 46 disposed paraxially beside the intermediate wheel 41, the back wheel 47 of which is in engagement with the second toothed ring 44 of the double wheel rotatably seated on the intermediate shaft 41. By means of an auxiliary drive device 48, the differential gear 46 permits an adjustment of the back wheel 47 in respect to the first wheel 45 having the same diameter. The auxiliary drive device 48 is rendered passive during normal production, so that the differential gear 46 acts like an inherently rigid double wheel. The adjusting disks 24 can be brought into the desired rotational position by actuation of the auxiliary drive device 48.

For its part, the intermediate shaft 41 seated in the gear box 38 can be driven at different speeds by means of the toothed drive ring 21 flanged to the outer drive wheel 11. A double wheel, seated on a journal fastened on the frame side and having two toothed rings 49, 50 of different diameter, is provided for this, which for their part are in engagement with drive wheels 51, 52 of different diameter, seated freely rotatable on the intermediate shaft 41. The latter can be alternatively coupled with the intermediate shaft 41 by means of a coupling part 53 which is displaceably wedged between them. For this purpose, the drive wheels 51, 52 are provided in the area of their mutually facing front ends with two axially protruding coupling claws, so that the result is defined coupling, in register. The coupling part 53 can be displaced by means of a gear lever 56 engaging a peripheral groove from a left engagement position, shown in FIG. 1, into a right engagement position. Thus, two different speeds of the cover devices can be achieved by an appropriate movement of the gear lever 56.

As can be further seen from FIG. 2, in the exemplary embodiment shown having a seven-part collect cylinder 1, the cam support 22 is provided with eight adjustable cover cams 17.1 to 17.8, the peripheral shape 23 of which has an angular extent of approximately 10° to 20° each.

The eight cover cams 17 are distributed in two opposite groups, offset from each other by 180°, of four cover cams 17.1, 17.2, 17.3, 17.4 in the first group and 17.5, 17.6, 17.7, 17.8 in the second group, each distributed over an angular extent of 90°. Each of two cover cams 17.1–17.5; 17.2–17.6; 17.3–17.7 and 17.4–17.8 are located diametrically opposite each other.

In this case the adjusting disk 24 is provided with six fixed peripheral cams 25.1 to 25.6, which are distributed in two groups of three peripheral cams 25.6, 25.1, 25.2; 25.3, 25.4, 25.5, offset by 180° from each other. The distances 1 to 6 (in angular measure) of the peripheral cams 25.1 to 25.6 are:

| |
|---|
| $\sphericalangle \eta$ 1 between peripheral cam 25.6 and 25.1 = 56.25°; |
| $\sphericalangle \eta$ 2 between peripheral cam 25.1 and 25.2 = 48.00°; |
| $\sphericalangle \eta$ 3 between peripheral cam 25.2 and 25.3 = 75.75°; |
| $\sphericalangle \eta$ 4 between peripheral cam 25.4 and 25.5 = 56.25°; |
| $\sphericalangle \eta$ 5 between peripheral cam 25.5 and 25.6 = 48.00°; |
| $\sphericalangle \eta$ 6 between peripheral cam 25.6 and 25.1 = 75.75°; |

In contrast to the cover cams 17.1–17.8, the peripheral cams 25.1 to 25.6 of the adjusting disk 24 have different peripheral lengths. The peripheral cams 25.1 to 25.6 have the following peripheral length (=switch position length) in angular measure: Peripheral cam 25.1: 1° to 2°; peripheral cam 25.2: 12° to 14°; peripheral cam 25.3: 22° to 24°; peripheral cam 25.4: 1° to 2°; peripheral cam 25.5: 12° to 14°; peripheral cam 25.6: 22° to 24°. The distance of the cover cams 17.1 to 17.8, measured in angles of arc (angular measure), is:

| |
|---|
| $\sphericalangle \alpha$ 1 between 17.1 and 17.2 = 45° |
| $\sphericalangle \alpha$ 2 between 17.2 and 17.3 = 15° |
| $\sphericalangle \alpha$ 3 between 17.3 and 17.4 = 30° |
| $\sphericalangle \alpha$ 4 between 17.4 and 17.5 = 90° |
| $\sphericalangle \alpha$ 5 between 17.5 and 17.6 = 45° |
| $\sphericalangle \alpha$ 6 between 17.6 and 17.7 = 15° |
| $\sphericalangle \alpha$ 7 between 17.7 and 17.8 = 30° |
| $\sphericalangle \alpha$ 8 between 17.8 and 17.1 = 90° |

The distance between two cover cams is measured each time from half the peripheral shape length to half the peripheral shape length, the cover cams 17.1 to 17.8 being in the extended position. This distribution of the cover cams 17.1 to 17.8 and of the peripheral cams 25.1 to 25.6 with the peripheral recesses 26 of the adjusting disk 24 located between each of the peripheral cams 25.1 to 25.6, together with the different drive speeds of the present seven-part collect cylinder 1, make possible every desired type of production from non-collect with the selectable employment of 4U-, 6U- or 8U-printing cylinders (A+B; A+B+C; A+B+C+D); dual collect with 4U- or 8U-printing cylinders (AB; AB+CD); triple collect, using 6U-printing cylinders (ABC); quadruple collect, using 8U-printing cylinders (ABCD); partial collect, using 6U-printing cylinders (AB+C); partial collect, using 8U-printing cylinders (A+BCD).

The setting of the adjusting disk 24 in respect to the cam support 22 and thus to the cover cams 17.1 to 17.8, which is the basis of FIG. 2, corresponds to the production mode non-collect with selectively 4U-, 6U- or 8U-printing cylinders, which results in a single-layer product. The adjusting disk 24 is adjusted in such a way, that none of the cover cams 17.1 to 17.8 are extended, i.e. each folding blade row 5 performs one folding operation, each gripper row 7 opens during the folding operation, because each one of the seven folding blade rows 5 or gripper rows 7 finds an available control recess 16 during each rotation of the collect cylinder and performs a folding operation. The same is true, of course, for the gripper rows 7. None of the cover cams 17.1 to 17.8 is extended. The drive speed, i.e. the rpm, of the cam supports 22 and the adjusting disks 24 is $\frac{7}{8}$ of the speed of the collect cylinder supporting seven folding blades and gripper rows each.

Figure 3:
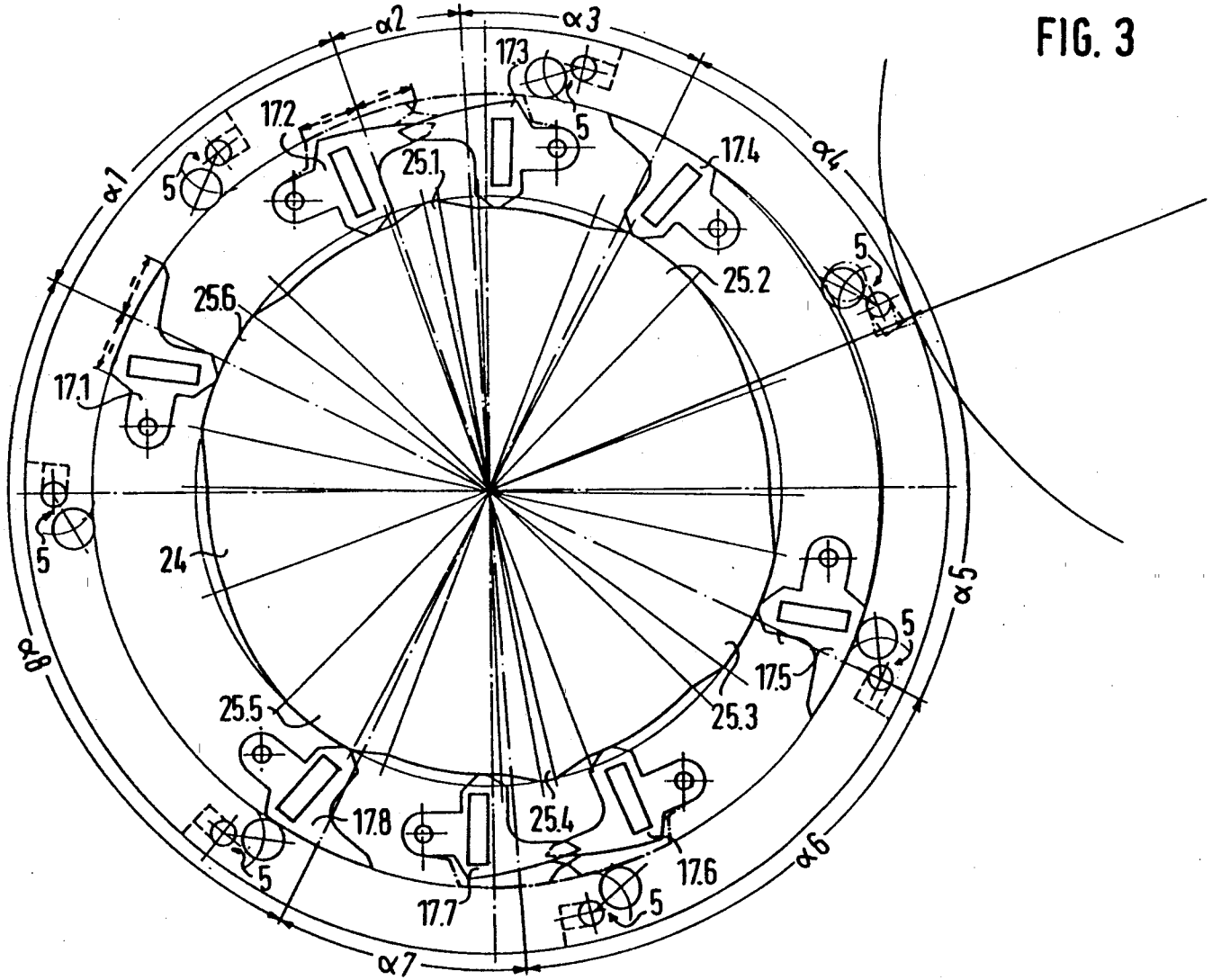

The setting of the adjusting disk 24 which is the basis of FIG. 3 corresponds to the production mode dual collect with the employment of 4U- and 6U-printing cylinders. A double-layer product is the result. The switch cams 17.1 and 17.4 or 17.5 and 17.8 are extended, the switch cams 17.2 and 17.3 or 17.6 and 17.7 are retracted. The drive speed of the cam support 22 and the adjusting disk 24 is $\frac{7}{8}$ of the speed of the collect cylinder 1. The control roller of each folding blade row 5 or gripper row 7 finds an uncovered control recess 16 during every second rotation of the collect cylinder and performs a folding operation, or the gripper row 7 opens.

Figure 4:
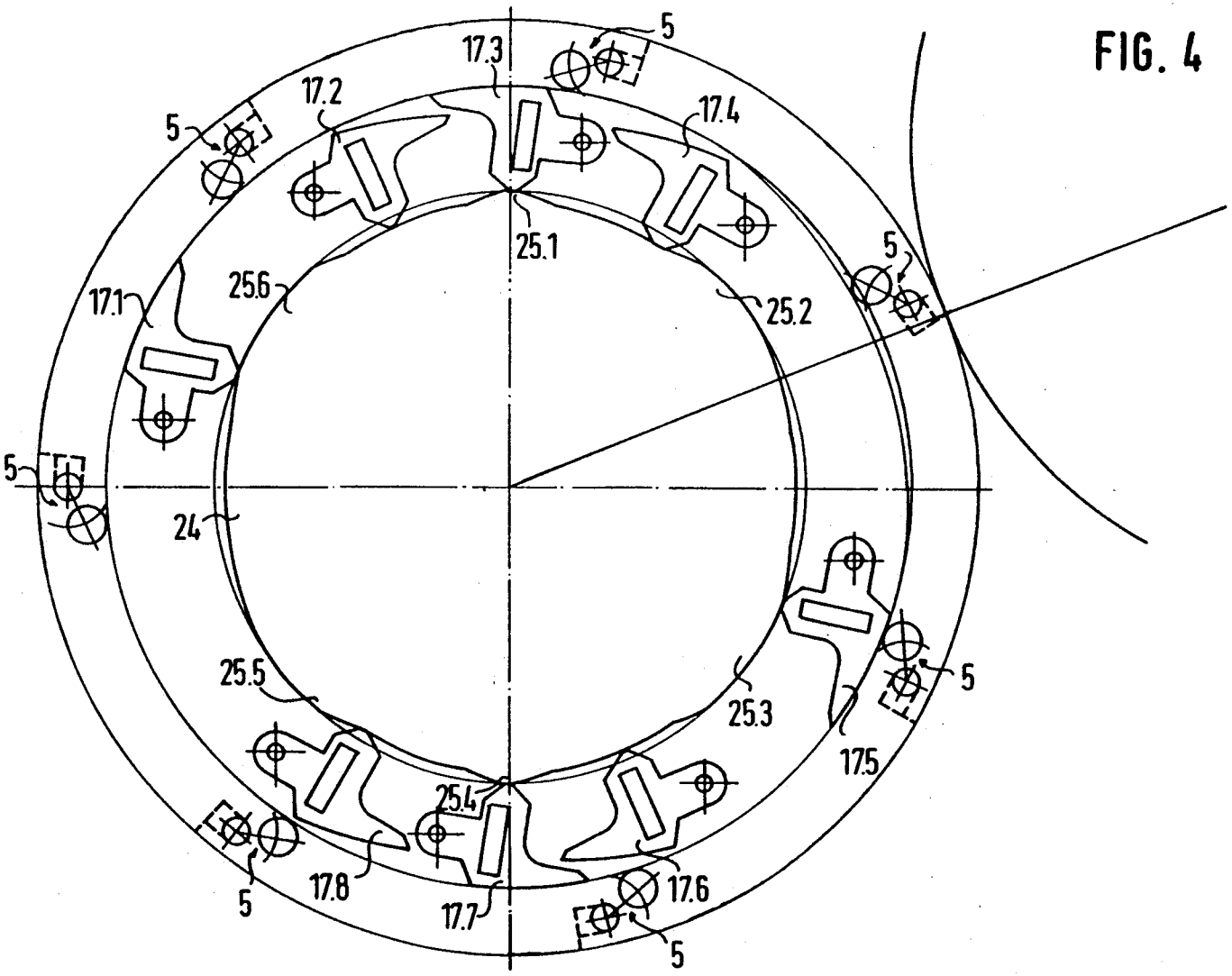

The setting of the adjusting disk 24 which is the basis of FIG. 4 corresponds to the production mode triple collect with the employment of 6U-printing cylinders. A triple-layer product is the result. The first and third switch cams 17.1 and 17.3 or 17.5 and 17.7 are extended, the switch cams 17.2 and 17.4 or 17.6 and 17.8 are retracted. The drive speed of the cam support 22 and the adjusting disk 24 is 7/6 of the speed of the collect cylinder 1. The control roller of each folding blade row 5 or gripper row 7 finds an uncovered control recess 16 during every third rotation of the collect cylinder and performs a folding operation, or the gripper row 7 opens.

Figure 5:
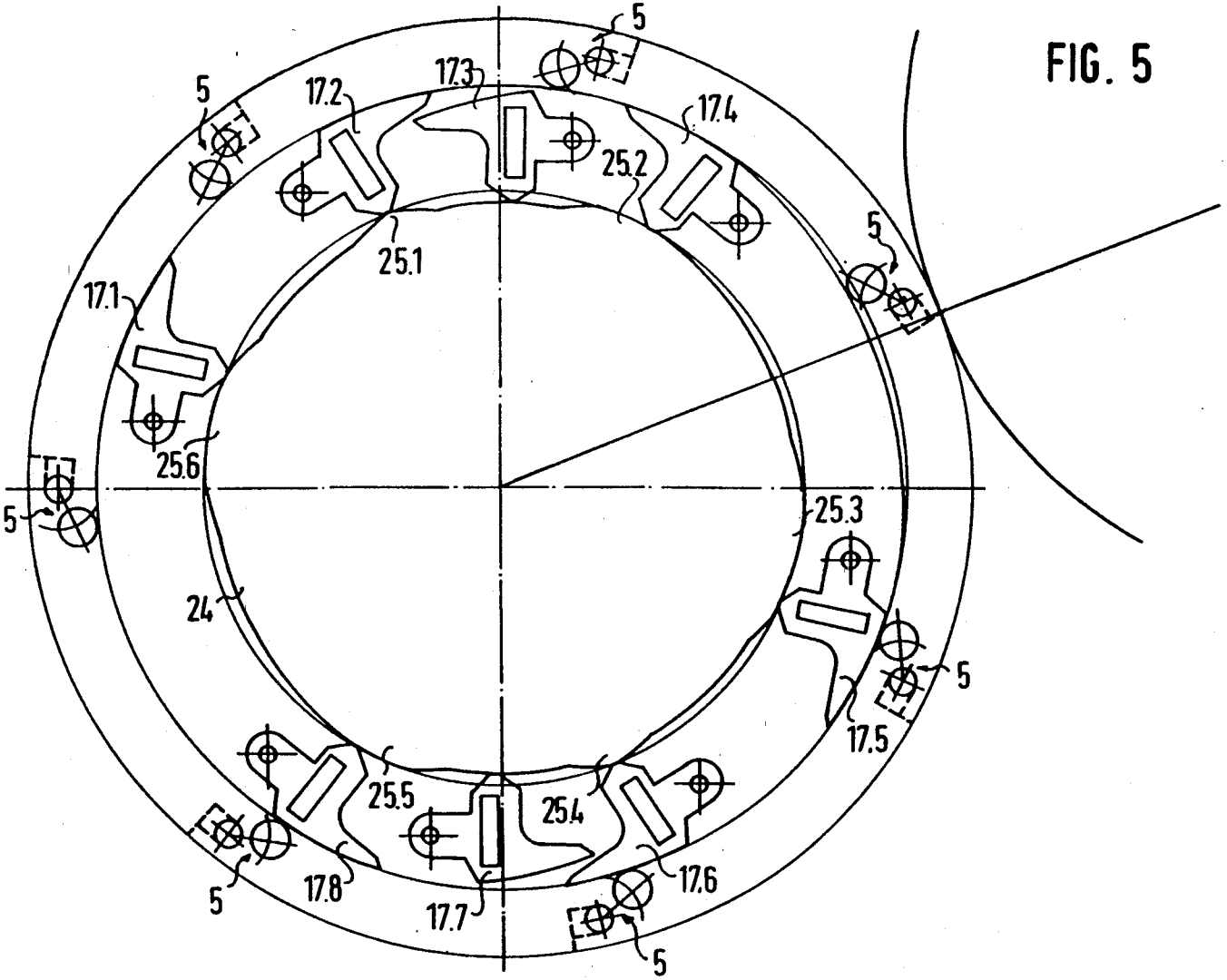

The setting of the adjusting disk 24 which is the basis of FIG. 5 corresponds to the production mode quadruple collect with the employment of 8U-printing cylinders. A quadruple-layer product is the result. The switch cams 17.1 and 17.4 or 17.5 and 17.8 are extended, the switch cams 17.2 and 17.3 or 17.6 and 17.7 are retracted. The drive speed of the cam support 22 and the adjusting disk 24 is $\frac{7}{8}$ of the speed of the collect cylinder 1. The control roller of each folding blade row 5 or gripper row 7 finds an uncovered control recess 16 during every fourth rotation of the collect cylinder and performs a folding operation, or the gripper row 7 opens.

Figure 6:
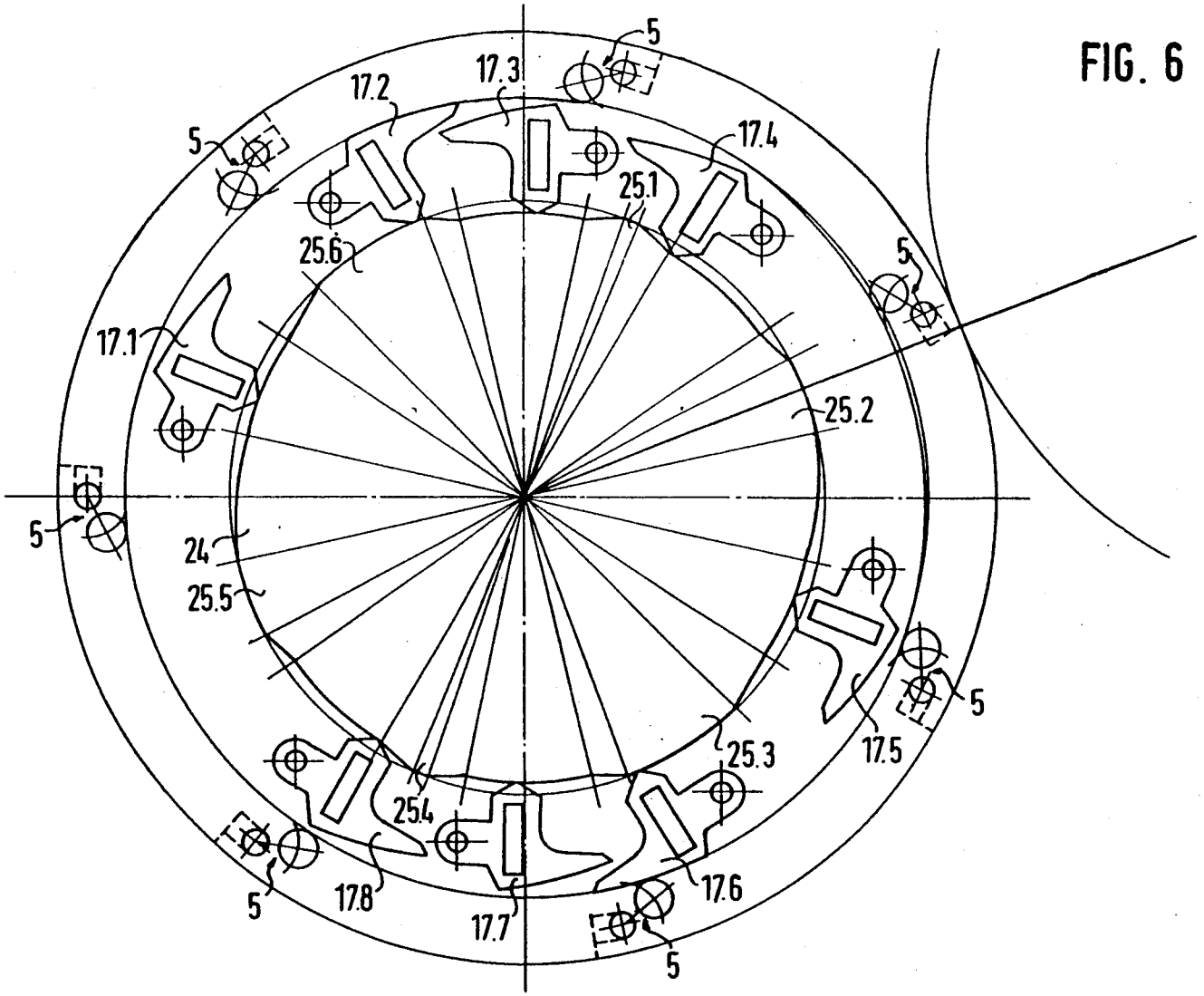

The setting of the adjusting disk 24 which is the basis of FIG. 6 corresponds to the production mode partial collect with the employment of 6U-printing cylinders, i.e. six copies (for example A, B, C, A, B, C) around the periphery. A single-layer plus a dual-layer product is the result. The switch cams 17.2 and 17.6 are extended, the switch cams 17.1, 17.3, 17.4, 17.5, 17.7 and 17.8 are retracted. The drive speed of the cam support 22 and the adjusting disk 24 is 7/6 of the speed of the collect cylinder 1. Each field on the collect cylinder 1 is controlled in such a way, that the folding blade row 5 or the gripper row 7 finds the control roller of a control recess 16 after one rotation and then must rotate twice until it again finds an uncovered control recess 16.

Figure 7:
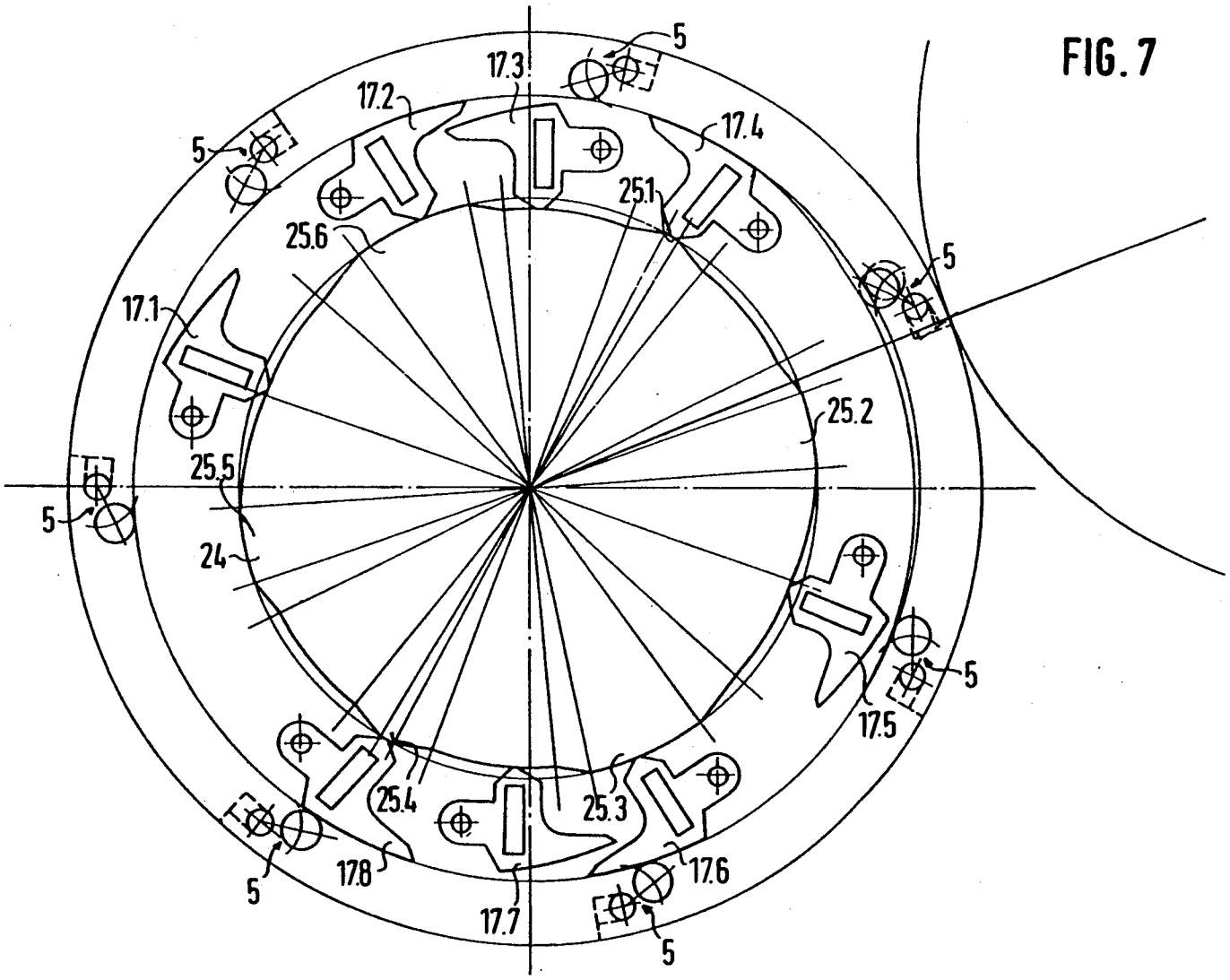
Figure 8:
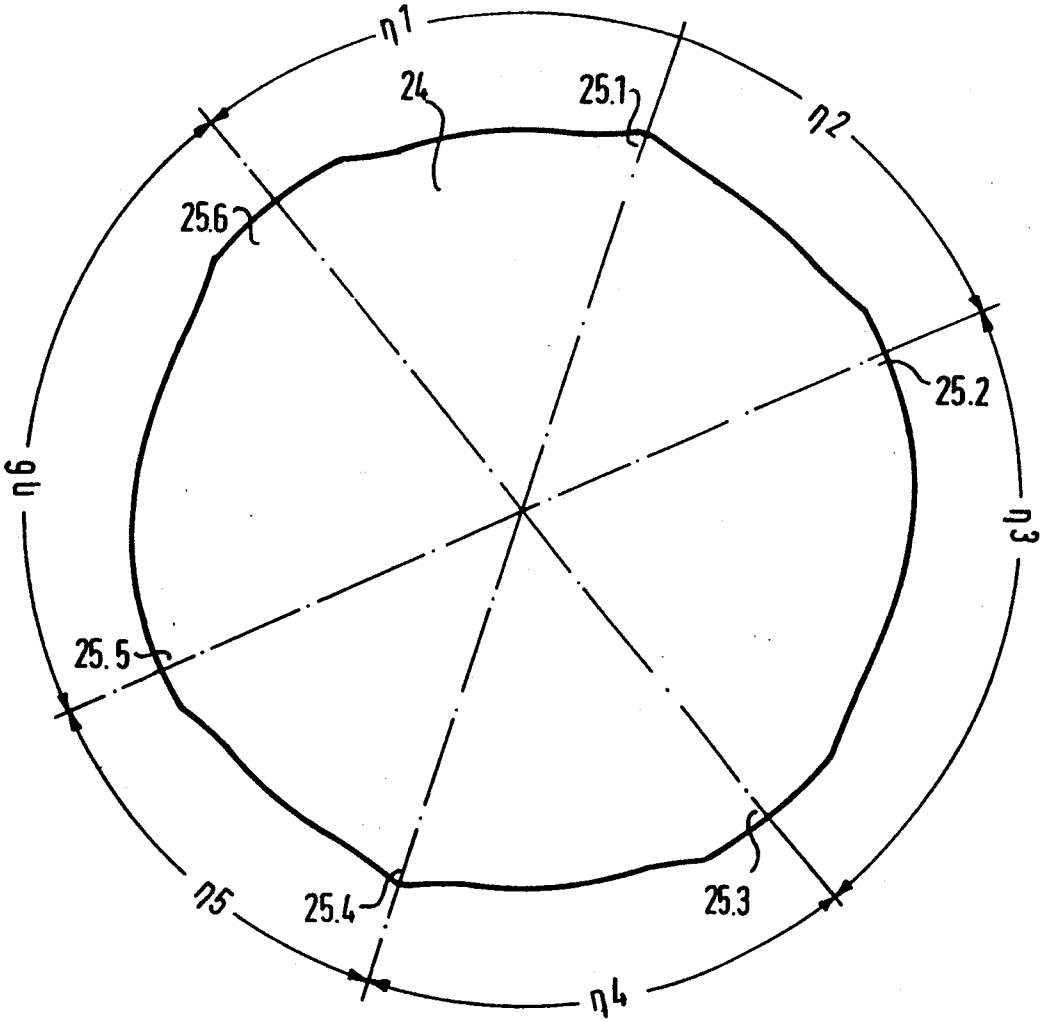

The setting of the adjusting disk 24 which is the basis of FIG. 7 corresponds to the production mode partial collect with the employment of 8U-printing cylinders, i.e. eight copies (for example A, B, C, D, A, B, C, D) around the periphery. A single-layer plus a triple-layer product is the result. The switch cams 17.2 and 17.4, 17.6 and 17.8 are extended, the switch cams 17.1, and 17.3 or 17.5 and 17.7 are retracted. The drive speed of the cam support 22 and the adjusting disk 24 is $\frac{7}{8}$ of the speed of the collect cylinder 1. Each field on the collect cylinder 1 is controlled in such a way, that the folding blade row 5 or the gripper row 7 finds the control roller of a control recess 16 after rotation and then must rotate three times until it again finds an uncovered control recess 16.

The structure and mode of operation of the cover device associated with the gripper control corresponds to the cover device of the folding blade control which is the basis of FIGS. 2 to 8 with only the difference, that the grippers 7 holding the start of the sheet have already passed through the folding gap when the folding operation is performed. Thus, activation of the folding blades 5 and opening of the grippers 7 takes place essentially simultaneously. However, these operations extend over a definite period of time, so that the opening of the grippers 7 during processing of short products should take place slightly sooner than in processing of longer products, which can be accomplished by means of the above described pivotability of the radial cam 13 on the gripper side because of the adjusting tongue 20.

In the case of a so-called double-wide folding apparatus, on which two products lying side-by-side can be processed, the gripper bars 8 and the folding blades 5 are distributed over the length of the cylinder and a separate control device is associated with each cylinder side. The construction of these two control devices can correspond to the construction of the control device for the right cylinder half shown in FIG. 1, only with the difference that the intermediate shaft 41 cannot be coupled with the cylinder drive by means of an associated claw coupling, but is connected with the opposite intermediate shaft 41 by means of a bridging shaft 57, as can also be seen in FIG. 1. This results in a common drive shaft extending over the entire cylinder width.

In the above described exemplary embodiment the adjustment of the cover cams takes place via associated adjusting disks 24, which makes possible automatic pre-setting by appropriate programming of the auxiliary drive device 48. However it would also be easily conceivable to adjust the cover cams 17.1–17.8 individually by hand in accordance with an appropriate guide. For this, the cam supports 22 would have to be simply supplied with suitable clamping devices for fixing the cover cams 17.1–17.8.

For setting the various production modes, the adjusting disk 24 with the peripheral cams 25.1 to 25.6 is set each time in such a way, that the cover cams 17.1 to 17.8 are brought into a position where the gripper rows and folding blade rows are activated at the correct moment. To switch the various production modes around, the adjusting disk 24 must be turned from the zero position = "production 4U-, 8U-non-collect" by an angle λ 1 to λ 5, so that the cover cams 17.1 to 17.8 are brought into the desired position. Thus, the adjusting disk 24 must be turned from the zero position by λ 1=0.5° counterclockwise in order to bring the cover cams 17.1 to 17.8 into the production position "6U-non-collect".

The adjusting disk 24 must be turned by λ 2=24° in order to bring the cover cams 17.1 to 17.8 into the production position "4U- or 8U-dual-collect".

The adjusting disk 24 must be turned by λ 3=12° in order to bring the cover cams 17.1 to 17.8 into the production position "6U-triple-collect".

The adjusting disk 24 must be turned by λ 4=34° in order to bring the cover cams 17.1 to 17.8 into the production position "8U-quadruple-collect".

The adjusting disk 24 must be turned counterclockwise by λ 5=12° in order to bring the cover cams 17.1 to 17.8 into the production position "8U-partial-collect".

The adjusting disk 24 must be turned clockwise by λ 6=22° in order to bring the cover cams 17.1 to 17.8 into the production position "6U-dual-collect".

4U- 6U-, 8U-printing means that there are 4 (for example A, B, A, B) or 6 (for example A, B, C, A, B, C) or 8 (for example A, B, C, D, A, B, C, D) copies (pages) of equal length disposed evenly spaced around the periphery of the printing cylinder. The copies of 4U, 6U and 8U are of equal length and can be variable within the permissible format size.

I claim:

1. A folding apparatus, in particular a variable folding apparatus for a web-fed rotary gravure printing press, with a collect cylinder which can be switched from collect production to non-collect production and is provided with seven holding elements embodied as gripper rows, and seven folding blade rows, the holding elements of which are connected with actuating elements embodied as scanner rollers, which can be controlled by a respectively associated radial cam, the control area of which, embodied as a control recess, can be selectively uncovered or covered by means of a cover device provided with eight cover cams disposed on a drivable cam support which is coaxial with the radial cam, the cover cams of each cover device are received radially displaceable on the respectively associated cam support, the cover cams are adjustable by means of an adjusting disk, which is coaxial with the cam support, which can be driven together with the cam support and is adjustable in relation to the latter in the peripheral direction, characterized in that a 6U-printing cylinder with six copies around its periphery is provided, that the folding apparatus is switched into the production mode "partial collect", that the second and the sixth cover cam are extended, and the first, the third, the fourth, the fifth, the seventh and the eighth cover cams are retracted, that the cover cams are extended for rendering the gripper rows and folding blade rows passive, and are retracted for the activation position.

2. A folding apparatus in accordance with claim 1, characterized in that the drive speed of the cam support and the adjustment disk is 7/6 of the speed of the collect cylinder.

3. A folding apparatus, in particular a variable folding apparatus for a web-fed rotary gravure printing press, with a collect cylinder which can be switched from collect production to non-collect production and is provided with seven holding elements embodied as gripper rows, and seven folding blade rows, the holding elements of which are connected with actuating elements embodied as scanner rollers, which can be controlled by a respectively associated radial cam, the control area of which, embodied as a control recess, can be selectively uncovered or covered by means of a cover device provided with eight cover cams disposed on a drivable cam support which is coaxial with the radial cam, the cover cams of each cover device are received radially displaceable on the respectively associated cam support, the cover cams are adjustable by means of an adjusting disk, which is coaxial with the cam support, which can be driven together with the cam support and is adjustable in relation to the latter in the peripheral direction, characterized in that an 8U-printing cylinder with eight copies around its periphery is provided, that the folding apparatus is switched into the production mode "partial collect", that the second, the fourth, the sixth, and the eighth cover cams are extended, and the first, the third, the fifth and the seventh cover cams are retracted, that the cover cams are extended for rendering the gripper rows and folding blade rows passive, and are retracted for the activation position.

4. A folding apparatus in accordance with claim 3, characterized in that the drive speed of the cam support and the adjustment disk is $\frac{7}{8}$ of the speed of the collect cylinder.

* * * * *